US006112907A

United States Patent [19]

Morehead

[11] Patent Number: 6,112,907

[45] Date of Patent: Sep. 5, 2000

[54] METHOD AND APPARATUS FOR SEPARATING CO-MINGLED MATERIALS

[75] Inventor: Gordon Morehead, Darlington, United Kingdom

[73] Assignee: Biomass Recycling Ltd., United Kingdom

[21] Appl. No.: 08/983,150

[22] PCT Filed: May 9, 1997

[86] PCT No.: PCT/GB97/01260

§ 371 Date: Jan. 14, 1998

§ 102(e) Date: Jan. 14, 1998

[87] PCT Pub. No.: WO97/43054

PCT Pub. Date: Nov. 20, 1997

[30] Foreign Application Priority Data

May 14, 1996 [GB] United Kingdom ..... 9610003

[51] Int. Cl.[7] ..... B07C 9/00

[52] U.S. Cl. ..... 209/691; 209/479; 209/694; 209/930

[58] Field of Search ..... 209/479, 480, 209/481, 691, 694, 930

[56] References Cited

U.S. PATENT DOCUMENTS 1,141,852 6/1915 Sutton et al. ..... 209/691 X 4,583,645 4/1986 Yamamoto ..... 209/694

4,978,011 12/1990 Gorlitz et al. ..... 209/691 X

FOREIGN PATENT DOCUMENTS 4-267979 9/1992 Japan ..... 209/691

1472151 4/1989 U.S.S.R. ..... 209/691

*Primary Examiner*—Tuan N. Nguyen

*Attorney, Agent, or Firm*—Clifford W. Browning; Woodard, Emhardt, Naughton, Moriarty & McNett

[57] ABSTRACT

A material separating apparatus which is particularly suitable for sorting different forms of waste material including a carrier, generally a table (1) having a surface (10) onto which material can be deposited; and a drive element (3) for providing the carrier surface with a reciprocating motion in the plane of the carrier surface; the drive element being arranged to provide, in use, an abrupt change of direction of the carrier surface at each end of its travel to provide a motion to cause different components of the material to be separated in consequence of obtaining different velocities in dependence on their physical properties, and the table surface having different sloping zones for channeling out different materials. The drive element uses an offset crank linkage which collapses at the end of travel in each direction enabling the inertia of the table to continue until it hits a stop and is then drawn back in the reverse direction by the linkage.

13 Claims, 3 Drawing Sheets

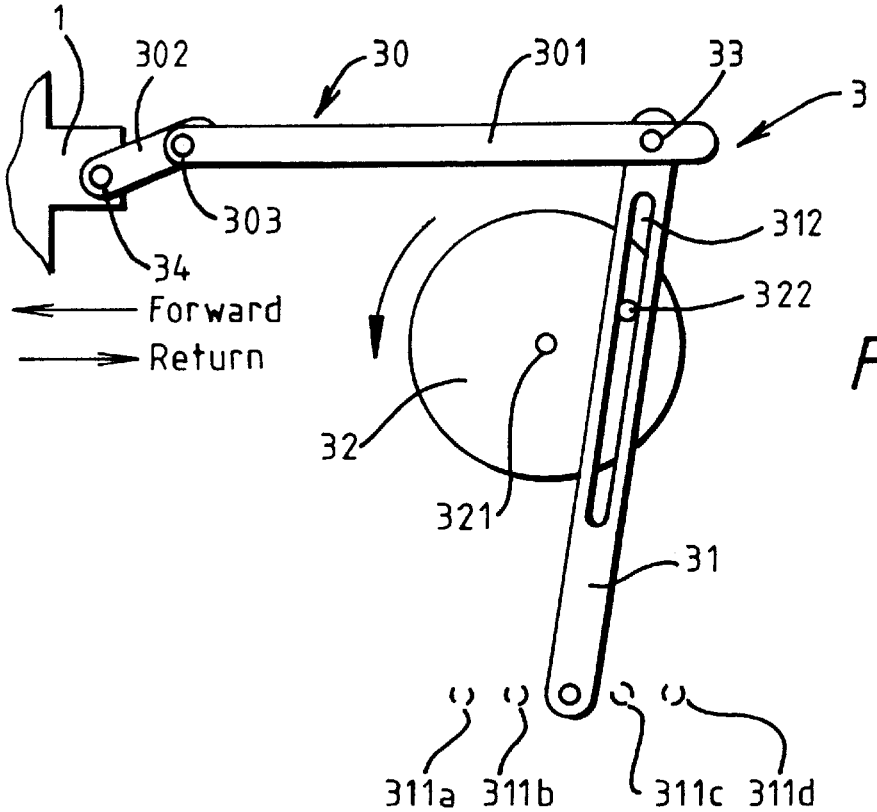
FIG. 4
FIG. 7a
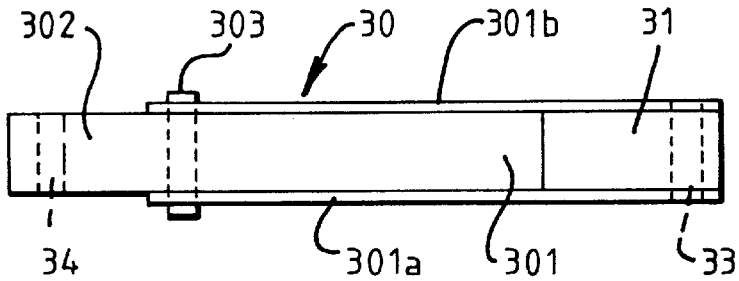
FIG. 7b
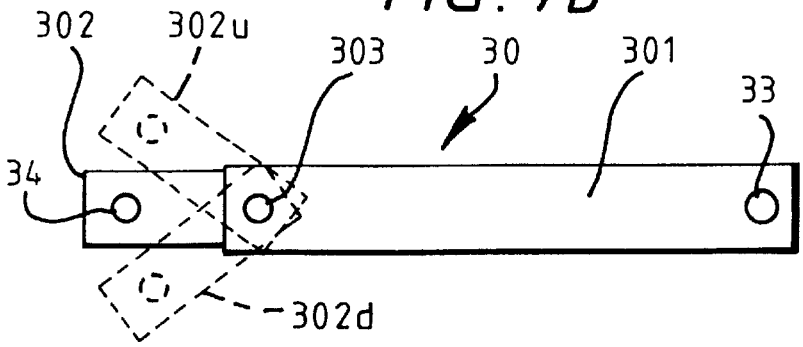

METHOD AND APPARATUS FOR SEPARATING CO-MINGLED MATERIALS

The present invention relates to an apparatus and a method for separating material, in particular waste material. Such material is normally in a co-mingled state and can consist of newspapers, cardboard, plastic bottles, glass, organic waste and other such items. The sorting of waste material is a major problem and many different systems have been developed in order to extract various components of the waste. For example, it is possible to extract metal components of the waste using magnetic or eddy current separators where appropriate. However, most existing systems can effectively sort only a limited number of types of waste and the present invention is directed at the provision of a system which can improve on this.

We have found that objects may be separated if placed on a carrier surface and that carrier surface is provided with a movement in the plane of the carrier surface. This effect can be partially accounted for because different objects experience different frictional forces and, therefore, are accelerated and decelerated by differing amounts.

Further certain objects may momentarily leave the carrier surface at which point air resistance becomes a dominant factor. In certain circumstances objects may bounce along the carrier surface and this can cause separation. The effect can be particularly pronounced if the movement of the carrier surface is such that resonance occurs so that certain objects only (or more frequently) contact the table when it is moving in one particular direction. The physical properties of the objects and the carrier surface will effect the natural frequency with which an object will bounce.

Both the velocity and acceleration with which the carrier surface moves are important in the separation process. Objects have a co-efficient of limiting friction and co-efficient of dynamic friction. These co-efficients depend on the composition and nature of surface of the object concerned. When the carrier surface is given a certain acceleration, the limiting friction will be overcome for some objects but not others. Those objects whose limiting friction is not overcome, will remain stationary relative to the carrier surface. If the limiting friction is overcome for a particular object, that object will then move with a certain velocity relative to the carrier surface. A frictional force, however, will still act on this object, and this force will be dependent on the object's co-efficient of dynamic friction. This frictional force will tend to decrease the relative velocity between the carrier surface and the object concerned. A moving object which is in contact with the carrier surface will always experience a force in the direction in which the table is moving. Therefore, if the table spends longer moving in one direction than another, each object will experience a force for a greater period of time in one direction than the other. This can have the effect of providing different objects with different velocities and thereby yield separation.

When objects leave the carrier surface the distance that they travel will depend on their momentum and the air resistance that they experience. The mass, density, surface area and the surface characteristics of the objects are therefore important. Different objects will leave the carrier surface dependent on its velocity and acceleration. If the surface spends longer travelling one direction than another, objects will tend to pick up more speed in that direction.

The separation effect can be enhanced by providing the carrier surface with variable acceleration so that, at different times, the limiting friction for different objects is overcome.

The separation may be amplified by using a carrier surface having a variable slope. Objects which have obtained a large velocity in a certain direction will tend to proceed in that direction. Objects with lesser velocities, will spend longer on the slope and therefore gain a higher velocity down the slope due to the action of gravity. The slope of the carrier surface can also encourage certain components of the material to become airborne.

Other factors such as the jostling between adjacent objects moving at different velocities, may also heighten the separation effect. Other surface force effects such as static electrical attraction may also play a role in the separation effect.

According to the present invention there is provided a material separating apparatus comprising:

- a carrier surface onto which material can be deposited; and
- a drive means for providing said carrier surface with a motion in the plane of said carrier surface;
- the arrangement being such that in use, said carrier surface accelerates and/or decelerates the material and different components of the material are separated in consequence of obtaining different velocities in dependence on their physical properties.

According to another aspect of the invention there is provided a method of separating material comprising the steps of:

- depositing material on a carrier surface;
- providing said carrier surface with a motion in the plane of said carrier surface; and
- retrieving separated material;
- said carrier surface accelerating and/or decelerating the material and different components of the material being separated in consequence of obtaining different velocities in dependence on their physical properties.

A generally preferred manner of carrying out the invention is to provide said carrier surface with a conveying motion. Then separation occurs due to some articles being conveyed and some not being conveyed, or being conveyed at a greater or lesser speed, due to the differential friction and/or differing tendencies to leave the carrier surface.

In a specific aspect of the invention the carrier surface may comprise a table member which is caused to move with a generally oscillatory motion, but having a stroke in a first direction slower than a stroke in a return direction.

The oscillatory motion may be made such that, the acceleration during the change from the first direction to the return direction is greater than the acceleration during the chance from the return direction to the first direction.

Alternatively, the conveyor surface may be part of a conveyor where conveying movement only occurs in one direction and the speed of movement is selected to enable separation to occur in that direction. An example of such a form of conveyor is where a stationary grid carrier has been meshed with a conveying grid which rises above the surface when moving in one direction, to provide conveying in that direction, and then drops below the level of the stationary grid conveyor in the return stroke.

A further possibility is to have a rotary table where a centrifugal force is applied to objects dependent on the relative friction and their tendency to leave the carrier surface.

Other combinations of linear and rotary motion can be provided to give other forms of motion that provide separation of the objects.

It is advantageous to be able to adjust the speed, frequency and duration of the motion of the carrier surface.

Preferably the carrier surface of the table member consists of a plurality of sections. Provision of slope adjustment means, so that it is possible to adjust the slope of any one of these sections, yields further advantages.

Preferably there is at least one feed chute for delivering material to the carrier surface. One or more of the feed chutes may be vibrated during use. If there are two or more feed chutes, then gaps can be provided between successive feed chutes so that some material is extracted before reaching the carrier surface.

As a result of these features, different types of waste can be sorted from one another by using a simple mechanical device.

A particular advantage is that the separating apparatus can remove a large proportion of the glass contained in waste material and is not damaged by glass. Once the majority of the glass has been extracted from the waste, the remaining material can be sorted using apparatus having rubber components which although cost effective are easily damaged by broken glass.

BRIEF DESCRIPTION OF THE DRAWINGS

An embodiment of the present invention will now be described by way of example, with reference to the accompanying drawings, in which:

FIG. 4 is a side elevation of the drive means;

FIGS. 7*a* and 7*b* are a plan view and front elevation of the table arm linkage respectively.

DETAILED DESCRIPTION OF THE PREFERRED EMBODIMENT

Figure 1:
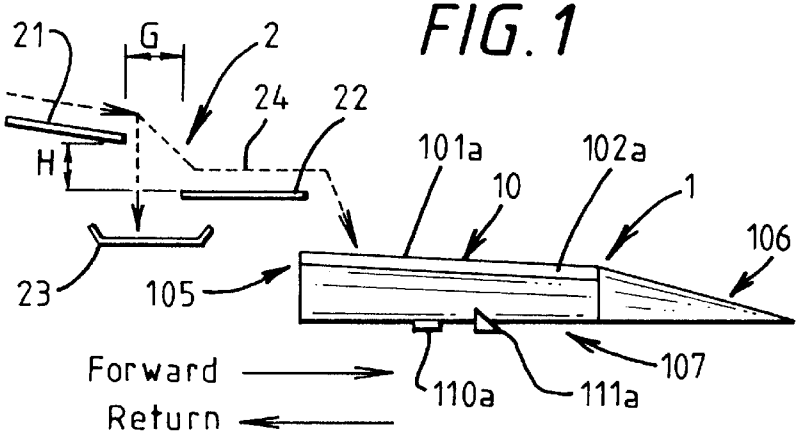
FIG. 1 is a side elevation of the separating apparatus.
Figure 3A:
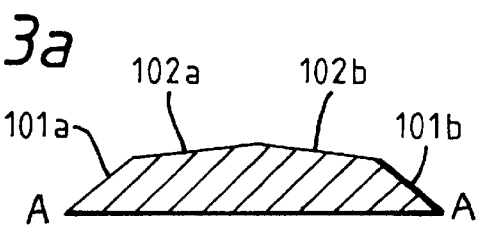
FIGS. 3*a*–3*d* are cross sections of the table member along lines A—A, B—B, C—C, D—D of FIG. 2.
Figure 3B:
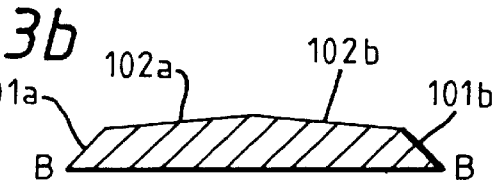
Figure 3C:
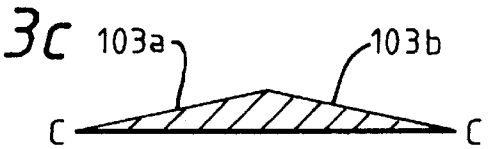
Figure 3D:
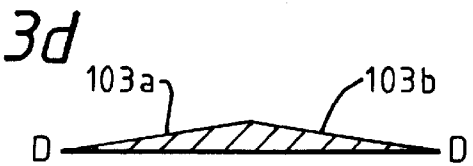

The material separating apparatus comprises three main parts, a table member 1, a chute arrangement 2, and a drive means 3.

The table member 1 has an upper carrier surface 10. The carrier surface 10 is made up of six separate but integral sections. These sections are right and left outer sections 101*a*, 101*b*, right and left inner sections 102*a*, 102*b*, and right and left front sections 103*a*, 103*b*.

The carrier surface 10 has a rear 105, a front 106, a right side 107 and a left side 108. The carrier surface 10 is symmetrical about a symmetry line 104. The carrier surface is divided by a transverse line 109. The right and left inner sections 102*a*, 102*b* are disposed either side of the symmetry line 104, towards the rear 105 of the table member 1. The right and left outer sections 101*a*, 101*b* are disposed outwardly from the right and left inner sections 102*a*, 102*b*. The transverse line 109 forms one end of the inner and outer sections 101*a*, 101*b*, 102*a*, 102*b*. The right and left front sections 103*a*, 103*b* are disposed forwards of the transverse line 109.

All of the carrier surface sections slope downwards towards the front 106 of the table member 1. The forwards slope of the front sections 103*a*, 103*b* is steeper than the forwards slope of the inner and outer sections of 101*a*, 101*b*, 102*a*, 102*b*.

All of the right side sections 101*a*, 102*a*, 103*a*, slope towards the right side 107 of the table member 1. All of the left side sections 101*b*, 102*b*, 103*b*, slope towards the left side 108 of the table member 1.

Referring to FIG. 3, the sideways slope of the inner sections 102*a*, 102*b* is greater on line A—A, than on the line B—B. The sideways slope of the outer sections 101*a*, 101*b* is greater at the line B—B, than at the line A—A. The sideways slope of the front sections 103*a*, 103*b*, is greater at the line C—C, than at the line D—D. The sideways slope of the outer sections 101*a*, 101*b* is always greater than the sideways slope of the inner sections 102*a*, 102*b*.

Means are provided to alter the slope of the various sections of the table member.

Figure 2:
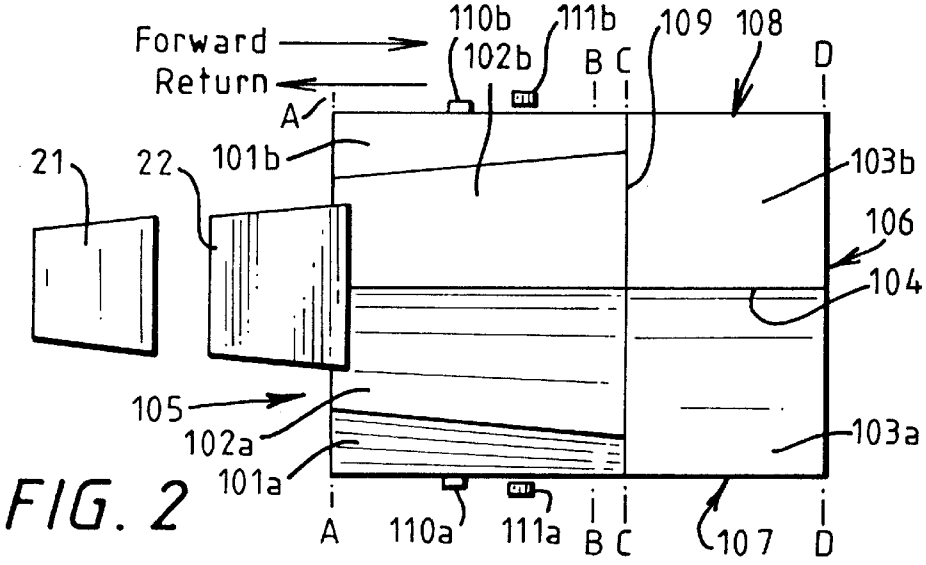
FIG. 2 is a plan view of the separating apparatus.
Figure 5A:
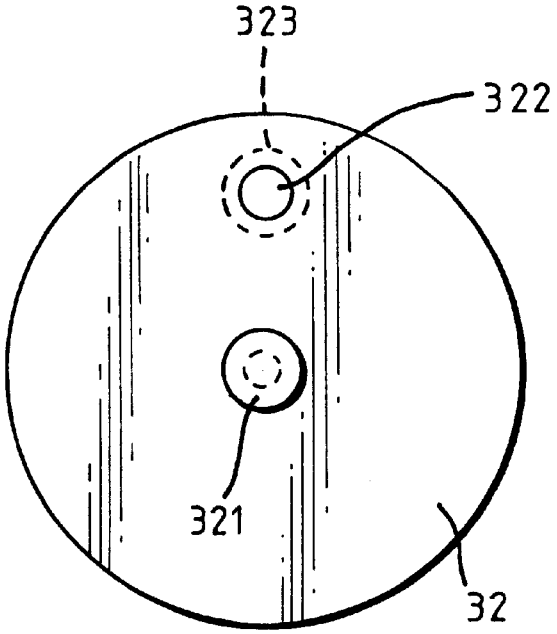
FIGS. 5*a* and 5*b* are front and side elevations of the flywheel respectively.
Figure 5B:
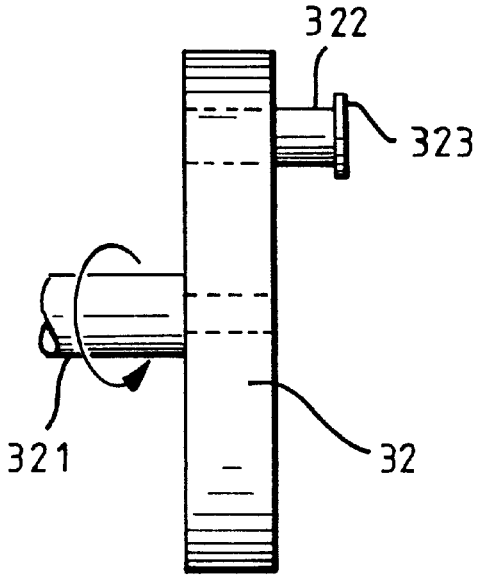

The apparatus includes a stop means comprising right and left stops 110*a*, 110*b* and right and left stop plates 111*a*, 111*b*. Referring to FIGS. 1 and 2, the right and left stops 110*a*, 110*b* are attached to the right and left sides 107, 108 of the table member 1. The right and left stop plates 111*a*, 111*b* are securely mounted to a stationary frame (not shown) and are disposed on either side of the table member 1 so that they can interact with the right and left stops 110*a*, 110*b*, respectively.

The chute arrangement 2 comprises a first chute 21 and a second chute 22, and a pre-sort collection member 23. The first and second chutes 21, 22, are separated by a gap G and a forward end of the first chute 21 is spaced upwardly from a rear end of the second chute 22 by a height spacing H. The pre-sort collection member 23 is disposed under the gap G and below the level of the first and second feed chutes 21, 22. The chute arrangement is held in a frame (not shown) and is disposed upwardly and rearwardly of the table member 1. The forward slope of the first chute 21 is steeper than that of the second chute 22.

Referring to FIG. 4, the drive means 3 comprises three main components, a table arm linkage 30, a pivot arm linkage 31 and the flywheel 32.

The pivot arm linkage 31 is rotatably mounted about the first axis 311 and comprises a slot 312.

Table arm linkage 30 comprises a first member 301 and a second member 302. The first member 301 is rotatably connected to the second member 302 by a connector 303. The first member 301 is further connected via a connector 33, to the pivot arm linkage 31. The second member 302 is further connected via a connector 34 to the table member 1. The first member 301 comprises a first side wall 301*a* and a second side wall 301*b*. These side walls sandwich the upper end of the pivot arm linkage 31 and the second member 302. The second member 302 may pivot round the connector 303, but its range of motion is constrained between an upper limit position 302*u* and a lower position limit 302*d*.

The flywheel 32 is arranged to be rotated around a second axis 321. The flywheel has a pin 322 spaced from this second axis 321. The pin 322 is located in the slot 312 of the pivot arm linkage 31. The pin 322 has an annular lip 323 which keeps the pin correctly located in the slot 312.

In operation, material is delivered to the first chute 21, from there it passes onto the second chute 22 and onwards to the table member 1. However, some of the material will fall through the gap G into the pre-sort collection member 23. This material may then be removed for further separation. Certain components of the waste, particularly plastic film, paper, organic material and fine powders, will tend to fall through the gap G.

Because the slope of the second chute 22 is shallower than the slope of the first chute 21, material will tend to be slowed down during its path across the second chute and, therefore, be delivered to the table with a reduced velocity.

The chute arrangement plays some part in the separation of material and its separating characteristics may be changed by vibrating the chutes, or by altering the width of the gap G, the size of the height spacing H, or the slope of either or both of the chutes. The dotted arrows 24 and 25 show various paths of the material through the chute arrangement.

In operation, the table member 1 is driven in an uneven oscillatory motion, such that its speed during a forward stroke is less than its speed during a return stroke. Further, the table member 1 is made to execute a snatch motion at the change of direction from the forward to the return direction. That is to say, the acceleration during the change of direction from the forward to return direction, is greater than the acceleration when the direction changes from the return to the forward direction. The material which is delivered to the table member 1 via the chute arrangement 2, will tend to be separated by these differing velocities and accelerations. Items experiencing extremely high friction will not be conveyed. All other items will tend to be conveyed in the forward direction from the rear of the table 105 to the front of the table 106. Those with the lowest friction will be generally expected to proceed in this direction most quickly. The various slopes of the different sections of the table amplify this separating effect. Objects which have picked up a high forward velocity will tend to leave the table member 1 towards the front, while those which have picked up little forward velocity will leave the table member 1 towards the sides. This is because the fast moving objects have less time in which to experience the gravitational forces which act on them.

The amount of time objects spend airborne and the occurrence of any resonance effects will also affect the paths followed by and the speeds of objects.

The arrangement of the drive means 3 is such that the table member 1 will be moved faster in a return direction than in a forward direction, and that there will be a snatch action when the direction of motion changes from the forward to the return direction. In operation, the flywheel 22 is rotated in an anti-clockwise sense. This causes the pin 322 to run up and down the slot 312. The action of the pin 322 on the slot 312 makes the pivot arm linkage move in the forward and return directions and consequently, the table arm linkage 30 moves in these directions, as does the table member 1.

Figure 6:
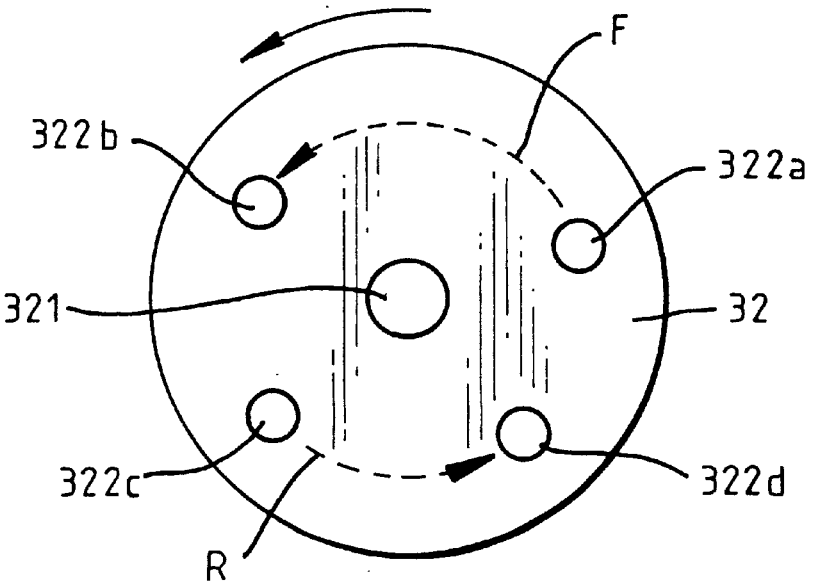
FIG. 6 is a front view of the flywheel showing loci of the pin.

Referring to FIG. 6, during the forward stroke the pin 322 moves from a first pin position to 322*a* to a second pin position 322*b*, following a locus F. During the return stroke of the table, the pin moves from a third pin position 322*c* to a fourth pin position 322*d*, following a locus R. The locus F is longer than the locus R, and this longer locus corresponds to a longer time because the flywheel rotates at a constant rate. As a result of this, the table member 1 spends a longer time moving in the forward direction than it does in the return direction. This means that the table member 1 must move correspondingly faster in the return direction. It will be appreciated that although the locus F is longer than the locus R, the connector 33 moves the same distance in the forward and return strokes because of the lever effect around the first axis 311.

The co-operation of the first and second members 301 and 302 and the stop means allow a snatch motion to be achieved as the direction of the table is changed from the forward to the return direction. During a first part of the forward stroke, the table arm linkage 30 is in a collapsed state; that is to say, the second member 302 has adopted either the upper limit position 302*u* or the lower limit position 302*d*. Towards the end of the forward stroke the speed of motion of the first member 301 is reduced because of the path of the pin 322, while the speed of the table member 1 is almost constant because of its inertia. This tends to elongate the table arm linkage 30; that is to say, the second member 302 tends to adopt a central position. At this point the right and left stops 110*a*, 110*b* strike the right and left stop plates 111*a*, 111*b*, which stops the table member 1 sharply and re-collapses the table arm linkage 30. Now however, the first member 301 is starting to move in the return direction and the table arm linkage 30 begins to elongate. When the table arm linkage 30 becomes fully elongated, the first member 301 is moving quickly in the return direction but the table member 1 is essentially stationary and therefore, the table member 1 experiences a sudden force and is snatched quickly backwards.

The table arm linkage 30 remains in the elongated state until the pin reaches the fourth pin position 322*d*. At this point the inertia of the table and the change of direction of the first member 301, tend to re-collapse the table arm linkage 30. Thus the table arm linkage 30 adopts the collapsed state, ready for the start of the next forward stroke.

To alter the length of the forward and return strokes the pivot arm linkage 31 may be made to pivot about any one of four pivot positions 311*a* to 311*d*. The second and third pivot positions 311*b*, 311*c* are disposed 19 mm either side of the first axis 311. The first and fourth pivot positions 311*a*, 311*d*, are disposed 19 mm outwardly of the second and third pivot positions 311*b*, 311*c*, respectively.

The Apparatus can be driven at various speeds including 42, 51, 55, 64, 69, 77 or 84 strokes per minute.

The flywheel 32 can be driven by an electric motor or any other suitable means.

In an alternative form of the invention other drive means can be used which give the appropriate uneven reciprocal motion. For example springs may be used which resist the motion in one direction but aid it in the other.

Alternatively a computer controlled drive means may be used.

In other alternatives the surface 10 of the table member 1 can comprise only one or any other number of sections. One or more of these sections may be substantially horizontal. One or more of these sections may be sloped upwards towards the front and/or the sides of the table.

In further alternatives one or any other number of feed chutes could be used.

In an alternative method, material may be pre-sorted using an apparatus according to the present invention or any conventional means, before it is fed to the table member. Further, or alternatively, the material can be further sorted once it has left the table member.

Amongst other things the apparatus and the method can be used to separate material consisting of newspaper, cardboard, steel and aluminium cans, glass jars and bottles, plastic bottles, dairy produce pots, plastic film and organic materials, wood and sawdust etc.

The separating characteristics of the apparatus may be altered by changing a number of different factors. These include: the length of stroke, the speed of stroke, frequency of stroke, the degree of table slopes, the methods of feeding the table, the arrangement of the chutes, Experiments can be carried out in order to produce an apparatus giving the separation effects desired.

An apparatus can be tuned to separate particular materials and adjustments can be made by an operator in response to the type of waste being delivered to the table. For example, if the waste contains a large amount of glass the speed of oscillation can be increased to effectively project the glass forward.

If a number of apparatuses according to the present invention are used in series, each can be set up to most effectively separate a different fraction of the waste.

Further the material of which the carrier surface is made and its structure will affect the behavior of the material which is deposited on the carrier surface. The carrier surface can be metal such as steel or aluminium sheet or a plastics material. The carrier surface can be arranged so that its deformation is minimized or so that it supported in such a way to encourage elastic deformation.

What is claimed is:

1. A material separating apparatus comprising:

A carrier having a surface onto which material can be deposited; and a drive means for providing said carrier surface with a reciprocating motion in the plane of said carrier surface; the drive means being provided with stop means adapted, in use, to stop suddenly the motion of the carrier surface at one end of its travel, the abrupt change in direction of the carrier surface providing a motion which causes different components of the material to be separated in consequence of obtaining different velocities in dependence on their physical properties.

2. A material separating apparatus according to claim 1 in which said motion is a reciprocating motion comprising a first stroke in a first direction and a second stroke in a return direction, and in which said second stroke is faster than said first stroke.

3. A material separating apparatus according to claim 2 in which the acceleration of the carrier surface when its motion changes direction from the first to the return direction is greater than the acceleration when the motion of the carrier surface changes from the return to the first direction.

4. A material separating apparatus according to claim 2 and further comprising an offset linkage for providing said first and second strokes of motion.

5. A material separating apparatus according to claim 1 in which the carrier surface comprises a plurality of sections having different slopes, to channel components travelling at different velocities.

6. A material separating apparatus according to claim 1 and further comprising an offset linkage for providing said first and second strokes of motion in which said offset linkage is arranged to cease providing drive as it approaches an extreme of its stroke to enable said stop means to operate in suddenly stopping the motion of the carrier surface, and, after the motion has stopped, to provide drive again in a reverse direction.

7. A material separating apparatus according to claim 6 in which said offset linkage includes a pivotal link which enables the linkage to collapse as it approaches extremes of its stroke so as to disengage drive for stopping and reversing motion of the carrier surface.

8. A material separating apparatus according to claim 3 and further comprising an offset linkage for providing said first and second strokes of motion.

9. A material separating apparatus according to claim 2 in which the carrier surface comprises a plurality of sections having different slopes, to channel components travelling at different velocities.

10. A material separating apparatus according to claim 3 in which the carrier surface comprises a plurality of sections having different slopes, to channel components travelling at different velocities.

11. A material separating apparatus according to claim 4 in which the carrier surface comprises a plurality of sections having different slopes, to channel components travelling at different velocities.

12. A material separating apparatus according to claim 8 in which the carrier surface comprises a plurality of sections having different slopes, to channel components travelling at different velocities.

13. A method of separating material comprising the steps of:

depositing material on a carrier surface; providing said carrier surface with a reciprocating motion in the plane of said carrier surface; and retrieving separated material; said carrier surface being arranged to stop suddenly at one end of its travel causing an abrupt change in direction so that different components of the material are separated in consequence of obtaining different velocities in dependence on their physical properties.

* * * * *